US007123115B2

(12) United States Patent
du Toit

(10) Patent No.: US 7,123,115 B2
(45) Date of Patent: Oct. 17, 2006

(54) LOADED LINE PHASE SHIFTER HAVING REGIONS OF HIGHER AND LOWER IMPEDANCE

(75) Inventor: Cornelis Frederik du Toit, Ellicott City, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 10/914,424

(22) Filed: Aug. 9, 2004

(65) Prior Publication Data

US 2005/0110595 A1 May 26, 2005

Related U.S. Application Data

(60) Provisional application No. 60/493,834, filed on Aug. 8, 2003.

(51) Int. Cl.
*H01P 1/18* (2006.01)

(52) U.S. Cl. ..... 333/161; 333/164

(58) Field of Classification Search ..... 333/161, 333/164, 139, 156
See application file for complete search history.

(56) References Cited

U.S. PATENT DOCUMENTS

| | | | | |
|---|---|---|---|---|
| 5,312,790 A | | 5/1994 | Sengupta et al. | 501/137 |
| 5,427,988 A | | 6/1995 | Sengupta et al. | 501/137 |
| 5,472,935 A | * | 12/1995 | Yandrofski et al. | 505/210 |
| 5,486,491 A | | 1/1996 | Sengupta et al. | 501/137 |
| 5,593,495 A | | 1/1997 | Masuda et al. | 117/4 |
| 5,635,433 A | | 6/1997 | Sengupta | 501/137 |
| 5,635,434 A | | 6/1997 | Sengupta | 501/138 |
| 5,640,042 A | | 6/1997 | Koscica et al. | 257/595 |
| 5,693,429 A | | 12/1997 | Sengupat et al. | 428/699 |
| 5,694,134 A | | 12/1997 | Barnes | 343/700 |
| 5,766,697 A | | 6/1998 | Sengupta et al. | 427/585 |
| 5,830,591 A | | 11/1998 | Sengupta et al. | 428/701 |
| 5,846,893 A | | 12/1998 | Sengupta et al. | 501/137 |
| 5,886,867 A | | 3/1999 | Chivukula et al. | 361/311 |
| 5,990,766 A | | 11/1999 | Zhang et al. | 333/205 |
| 6,029,075 A | * | 2/2000 | Das | 505/210 |
| 6,074,971 A | | 6/2000 | Chiu et al. | 501/139 |
| 6,377,142 B1 | | 4/2002 | Chiu et al. | 333/238 |
| 6,377,217 B1 | | 4/2002 | Zhu et al. | 343/700 |
| 6,377,440 B1 | | 4/2002 | Zhu et al. | 361/311 |

(Continued)

OTHER PUBLICATIONS

PCT International Search Report for International Application No. PCT/US04/25879 dated Apr. 10, 2006.

*Primary Examiner*—Benny Lee
(74) *Attorney, Agent, or Firm*—James S. Finn

(57) ABSTRACT

An embodiment of the present invention provides a phase shifter, comprising: a base dielectric layer; a tunable dielectric layer overlaying at least a portion of the base dielectric layer; and at least two conductors overlaying at least a portion of the tunable dielectric layer, the at least two conductors positioned so as to form a slot-line topology. In an embodiment of the present invention the slot-line may be between 2 μm and 5 μm wide and the tunable dielectric layer may be between 0.3 μm to 1.5 μm thick. Further, the slot-line topology may be a uniform slot-line topology throughout the length of the at least two conductors and the slot-line topology may have an edge ratio defined by $r=L_{low}/(L_{low}+L_{high})$. The edge ratio may be optimized for minimizing metal loss and minimizing dielectric loss for a given phase shifter length. In an embodiment of the present invention the value of r may be between 0.1 and 0.2.

25 Claims, 6 Drawing Sheets

U.S. PATENT DOCUMENTS

| | | | | |
|---|---|---|---|---|
| 6,404,614 | B1 | 6/2002 | Zhu et al. | 361/277 |
| 6,492,883 | B1 | 12/2002 | Liang et al. | 333/132 |
| 6,514,895 | B1 | 2/2003 | Chiu et al. | 501/137 |
| 6,525,630 | B1 | 2/2003 | Zhu et al. | 333/205 |
| 6,531,936 | B1 | 3/2003 | Chiu et al. | 333/164 |
| 6,535,076 | B1 | 3/2003 | Partridge et al. | 333/17.1 |
| 6,538,603 | B1 | 3/2003 | Chen et al. | 342/372 |
| 6,556,102 | B1 | 4/2003 | Sengupta et al. | 333/161 |
| 6,590,468 | B1 | 7/2003 | du Toit et al. | 333/17.3 |
| 6,597,265 | B1 | 7/2003 | Liang et al. | 333/204 |

* cited by examiner

LOADED LINE PHASE SHIFTER HAVING REGIONS OF HIGHER AND LOWER IMPEDANCE

CROSS-REFERENCE TO RELATED APPLICATION

This application claims the benefit of priority under 35 U.S.C Section 119 from U.S. Provisional Application Ser. No. 60/493,834, filed Aug. 08, 2003, entitled "Loaded Line Phase Shifter," by Cornelis Frederik du Toit.

BACKGROUND OF THE INVENTION

A typical transmission line type phase shifter may consist of an input port, followed by a matching section, a variable transmission line section, a matching section and finally an output port. From a manufacturing point of view, some of the best variable transmission line topologies to use at these high frequencies include slot-type transmission lines, such as slotlines and co-planar waveguides (CPW). A slotline can be packaged into a rectangular or circular waveguide, where it is known as a finline, since the conductors around the slots are fin-like protrusions from the waveguide walls. Since a CPW line is essentially just two coupled, parallel slots, all of its properties may also be explained in terms of a single slot or slotline. Further, a CPW line may be more suitable for surface mount packaging.

The tunable material may be tuned by biasing it with a DC voltage across the slot gap. The wider the gap, the higher the biasing voltage needs to be. From a bias voltage control point of view, it is desirable to have a low bias voltage, i.e. a narrow gap. But a narrow gap has a low characteristic transmission line impedance, and is associated with high conductor currents and hence high loss.

Thus, there is a strong need in the phase shifter art for a solution to these conflicting requirements and for improved practical tunable transmission lines.

SUMMARY OF THE INVENTION

An embodiment of the present invention provides a phase shifter, comprising a base dielectric layer; a tunable dielectric layer overlaying at least a portion of the base dielectric layer; and at least two conductors overlaying at least a portion of the tunable dielectric layer, the at least two conductors positioned so as to form a slot-line topology. In an embodiment of the present invention the slot-line may be between 2 μm and 5 μm wide and the tunable dielectric layer may be between 0.3 μm to 1.5 μm thick. Further, the slot-line topology may be a uniform slot-line topology throughout the length of the at least two conductors and the slot-line topology may have an edge ratio defined by $r=L_{low}/(L_{low}+L_{high})$. The edge ratio may be optimized for minimizing metal loss and minimizing dielectric loss for a given phase shifter length. In an embodiment of the present invention the value of r may be between 0.1 and 0.2.

In yet another embodiment of the present invention is provided a phase shifter, comprising: a base dielectric layer; a first conductor overlaying at least a portion of the base dielectric layer; a tunable dielectric layer overlaying at least a portion of the base dielectric layer and a portion of the first conductor; a second conductor overlaying at least a portion of the tunable dielectric layer and a portion of the base dielectric layer. An embodiment of the present invention may provide that the second conductor overlaying at least a portion of the tunable dielectric layer and a portion of the base dielectric layer forms a slot-line topology and wherein a portion of the tunable dielectric layer that the second conductor overlays, is a portion that includes the portion wherein the tunable dielectric layer overlays the first conductor.

In still another embodiment of the present invention is provided a method of tuning a phase shifter, comprising: applying a voltage across a slot-line topology, the slot-line topology formed from: a base dielectric layer; a tunable dielectric layer overlaying at least a portion of the base dielectric layer; at least two conductors overlaying at least a portion of the tunable dielectric layer, the at least two conductors positioned so as to form the slot-line topology.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DESCRIPTION OF THE PREFERRED EMBODIMENT

Figure 1:
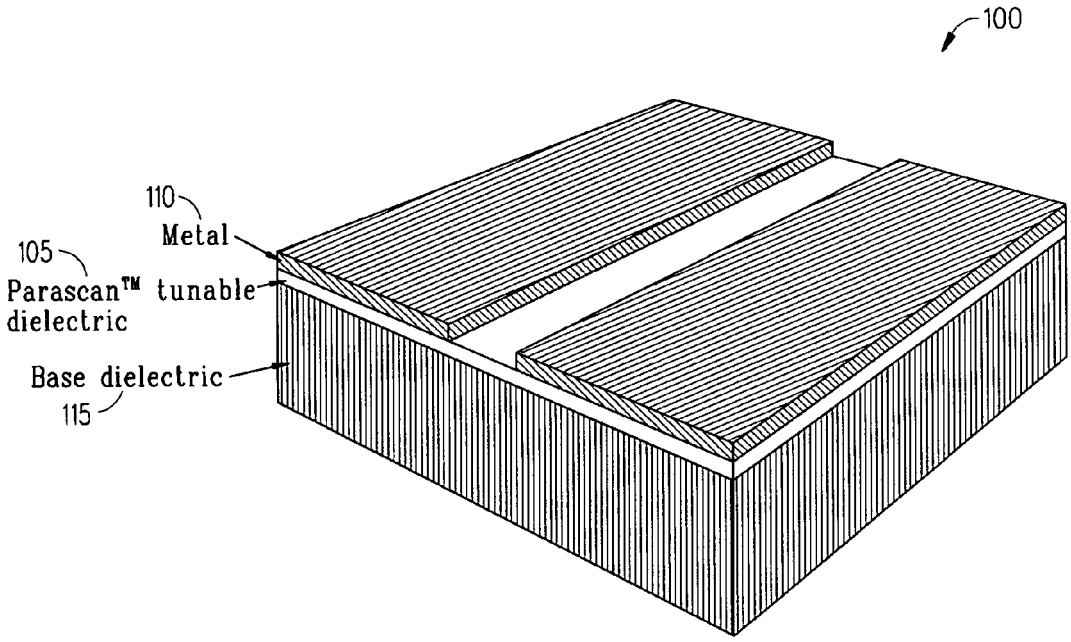
FIG. 1 depicts a basic slotline geometry with tunable material loading.

At frequencies from about 10 to 70 GHz, Paratek® phase shifters are designed around the concept of a tunable transmission line section, where the propagation velocity of the Parascan® material is tuned to create a variable propagation delay through the transmission line section.

The term Parascan® as used herein is a trademarked term indicating a tunable dielectric material developed by the assignee of the present invention. Parascan® tunable dielectric materials have been described in several patents. Barium strontium titanate ($BaTiO_3$—$SrTiO_3$), also referred to as BSTO, is used for its high dielectric constant (200–6,000) and large change in dielectric constant with applied voltage (25–75 percent with a field of 2 Volts/micron). Tunable dielectric materials including barium strontium titanate are disclosed in U.S. Pat. No. 5,312,790 to Sengupta, et al. entitled "Ceramic Ferroelectric Material"; U.S. Pat. No. 5,427,988 by Sengupta, et al. entitled "Ceramic Ferroelectric Composite Material-BSTO-MgO"; U.S. Pat. No. 5,486,491 to Sengupta, et al. entitled "Ceramic Ferroelectric Composite Material-BSTO-ZrO2"; U.S. Pat. No. 5,635,434 by Sengupta, et al. entitled "Ceramic Ferroelectric Composite Material-BSTO-Magnesium Based Compound"; U.S. Pat. No. 5,830,591 by Sengupta, et al. entitled "Multilayered Ferroelectric Composite Waveguides"; U.S. Pat. No. 5,846,893 by Sengupta, et al. entitled "Thin Film Ferroelectric Composites and Method of Making"; U.S. Pat. No. 5,766,697 by Sengupta, et al. entitled "Method of Making Thin Film Composites"; U.S. Pat. No. 5,693,429 by Sengupta, et al. entitled "Electronically Graded Multilayer Ferroelectric Composites"; U.S. Pat. No. 5,635,433 by Sengupta entitled "Ceramic Ferroelectric Composite Material BSTO-ZnO"; U.S. Pat. No. 6,074,971 by Chiu et al. entitled "Ceramic Ferroelectric Composite Materials with Enhanced Electronic Properties BSTO Mg Based Compound-Rare Earth Oxide". These patents are incorporated herein by reference. The materials shown in these patents, especially BSTO-MgO composites, show low dielectric loss and high tunability. Tunability is defined as the fractional change in the dielectric constant with applied voltage.

Barium strontium titanate of the formula $Ba_xSr_{1-x}TiO_3$ is a preferred electronically tunable dielectric material due to its favorable tuning characteristics, low Curie temperatures and low microwave loss properties. In the formula $Ba_xSr_{1-x}TiO_3$, x can be any value from 0 to 1, preferably from about 0.15 to about 0.6. More preferably, x is from 0.3 to 0.6.

Other electronically tunable dielectric materials may be used partially or entirely in place of barium strontium titanate. An example is $Ba_xCa_{1-x}TiO_3$, where x is in a range from about 0.2 to about 0.8, preferably from about 0.4 to about 0.6. Additional electronically tunable ferroelectrics include $Pb_xZr_{1-x}TiO_3$ (PZT) where x ranges from about 0.0 to about 1.0, $Pb_xZr_{1-x}SrTiO_3$ where x ranges from about 0.05 to about 0.4, $KTa_xNb_{1-x}O_3$ where x ranges from about 0.0 to about 1.0, lead lanthanum zirconium titanate (PLZT), $PbTiO_3$, $BaCaZrTiO_3$, $NaNO_3$, $KNbO_3$, $LiNbO_3$, $LiTaO_3$, $PbNb_2O_6$, $PbTa_2O_6$, $KSr(NbO_3)$ and $NaBa_2(NbO_3)$ $5KH_2PO_4$, and mixtures and compositions thereof. Also, these materials can be combined with low loss dielectric materials, such as magnesium oxide (MgO), aluminum oxide ($Al_2O_3$), and zirconium oxide ($ZrO_2$), and/or with additional doping elements, such as manganese (MN), iron (Fe), and tungsten (W), or with other alkali earth metal oxides (i.e. calcium oxide, etc.), transition metal oxides, silicates, niobates, tantalates, aluminates, zirconnates, and titanates to further reduce the dielectric loss.

In addition, the following U.S. Patent Applications, assigned to the assignee of this application, disclose additional examples of tunable dielectric materials: U.S. Pat. No. 6,514,895 filed Jun. 15, 2000, entitled "Electronically Tunable Ceramic Materials Including Tunable Dielectric and Metal Silicate Phases"; U.S. Pat. No. 6,774,077 filed Jan. 24, 2001, entitled "Electronically Tunable, Low-Loss Ceramic Materials Including a Tunable Dielectric Phase and Multiple Metal Oxide Phases"; U.S. Pat. No. 6,737,179 filed Jun. 15, 2001, entitled "Electronically Tunable Dielectric Composite Thick Films And Methods Of Making Same"; U.S. Pat. No. 6,617,062 filed Apr. 13, 2001, entitled "Strain-Relieved Tunable Dielectric Thin Films"; and U.S. Pat. No. 6,905,989 filed Jun. 1, 2001 entitled "Tunable Dielectric Compositions Including Low Loss Glass Frits". These patent applications are incorporated herein by reference.

Turning back to FIG. 6 at 600 is shown the topology of a loaded slotline geometry of one embodiment of the present invention. Although it is understood and will be discussed in greater detail below, there are a large number of topologies that may be used in the present invention. The wider conductors 630 used in FIG. 6 feeding the low impedance sections 625 (which may also be regarded as varactors, such as, but not limited to, Parascan® varactors) are better suited for producing a low loss phase shifter. The total length of a phase shifter based on this topology is still comparatively long (compared to a uniform slotline or CPW line). Metal is shown at 610 with narrow gap, high capacitance loads being illustrated at 605 followed by a uniform slotline 615. As previously mentioned, the edge ratio is shown at 620. Edge ratio r may be defined as $r=L_{low}/(L_{low}+L_{high})$, with $L_{high}$ being the impedance of said conductor with higher relative impedance and $L_{low}$ being the impedance of said conductor with lower impedance. $W_{high}$ illustrates the width of the high impedance conductor and $W_{low}$ shows the width of the lower impedance conductor. L1 illustrates the total length of one high impedance conductor and one low impedance conductor.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include $CaZrO_3$, $BaZrO_3$, $SrZrO_3$, $BaSnO_3$, $CaSnO_3$, $MgSnO_3$, $Bi_2O_{3/2}SnO_2$, $Nd_2O_3$, $Pr_7O_{11}$, $Yb_2O_3$, $Ho_2O_3$, $La_2O_3$, $MgNb_2O_6$, $SrNb_2O_6$, $BaNb_2O_6$, $MgTa_2O_6$, $BaTa_2O_6$ and $Ta_2O_3$.

Thick films of tunable dielectric composites can comprise $Ba_{1-x}Sr_xTiO_3$, where x is from 0.3 to 0.7 in combination with at least one non-tunable dielectric phase selected from MgO, $MgTiO_3$, $MgZrO_3$, $MgSrZrTiO_6$, $Mg_2SiO_4$, $CaSiO_3$, $MgAl_2O_4$, $CaTiO_3$, $Al_2O_3$, $SiO_2$, $BaSiO_3$ and $SrSiO_3$. These compositions can be BSTO and one of these components, or two or more of these components in quantities from 0.25 weight percent to 80 weight percent with BSTO weight ratios of 99.75 weight percent to 20 weight percent.

The electronically tunable materials can also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$—$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $Ka_1Si_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides. Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases are typically present in total amounts of from about 1 to about 80 weight percent of the material, preferably from about 3 to about 65 weight percent, and more preferably from about 5 to about 60 weight percent. In one preferred embodiment, the additional metal oxides comprise from about 10 to about 50 total weight percent of the material. The individual amount of each additional metal oxide may be adjusted to provide the desired properties. Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

The additional metal oxide phases can include at least two Mg-containing compounds. In addition to the multiple Mg-containing compounds, the material may optionally include Mg-free compounds, for example, oxides of metals selected from Si, Ca, Zr, Ti, Al and/or rare earths.

Figure 2:
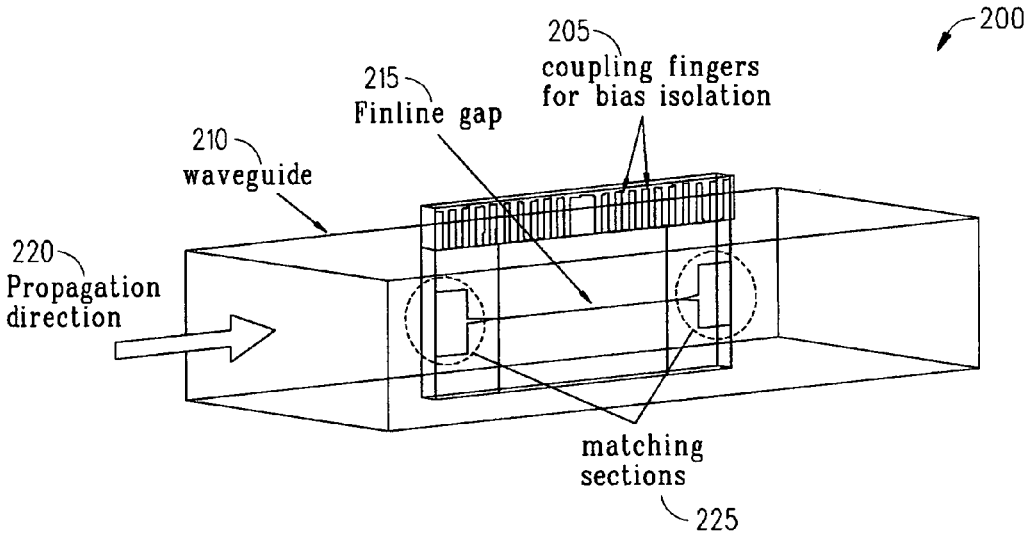
FIG. 2 illustrates a basic finline design.

A typical tunable slot-line geometry utilizing Parascan® tunable material is shown in FIG. 1 at 100. Although Parascan tunable material is used in this embodiment of the present invention, it is appreciated that any tunable material is intended to be within the scope of the present invention. This tunable slot-line includes metal conductors 110 with a tunable dielectric material 105 sandwiched between a base dielectric 115 and the metal layers. As mentioned above and as seen in FIG. 2, shown generally as 200, a slotline can be packaged into a rectangular or circular waveguide 210, where it is known as a finline with a finline gap 215, since the conductors around the slots are fin-like protrusions 205 from the waveguide walls. Matching sections of the CPW are shown at 225 with the direction of propagation illustrated at 220. The waveguide itself is grounded, which in turn grounds the bottom fin. The top fin is biased by connecting (by an insulated wire connection, for example and not by way of limitation, not shown), and is isolated from the waveguide. RF connection of the top fin with the waveguide is ensured by the use of quarter wave long coupling fingers protruding into a recess in the waveguide wall.

Figure 3:
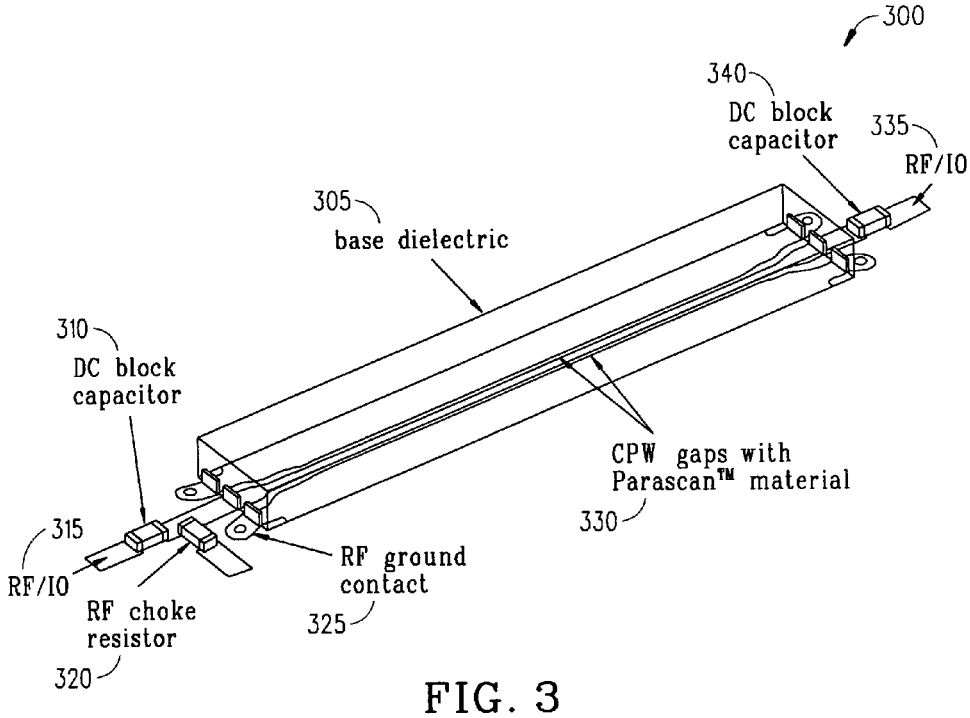
FIG. 3 illustrates a surface mount co-planar waveguide (CPW) phase shifter.

Since a CPW line is essentially just two coupled, parallel slots, all of its properties can also be explained in terms of a single slot or slotline. A CPW line is more suitable for surface mount packaging as shown in FIG. 3 at 300, which provides a surface mount CPW phase shifter with a RF I/O at 315 and 335 capable of inputting and outputting an RF signal via DC block capacitors 310 and 340 and RF choke 320. RF grounding is provided by RF ground contact 325 and situated between conductors is a CPW gap with tunable material 330 therein, such as Parascan tunable dielectric material. A base dielectric is provided at 305.

A well known method for reducing the bias voltage without incurring extra loss is to use a loaded or distributed transmission line. In this technique, variable transmission line sections of the phase shifter may not be uniform, but rather may consist of cascaded sections alternating between a non-tunable, high characteristic impedance section, and a tunable, low impedance section. By keeping the lengths of these alternating regions much shorter than a wavelength (typically, although not limited in this respect), the average impedance of the slotline is raised, thereby reducing the current strengths and hence the loss per unit length. But the amount of phase shift produced per unit length is also reduced; therefore the total length of the phase shifter is longer, which in turn would tend to increase the total loss again. These opposing facts imply that there exist an optimum ratio between the tunable and non-tunable section electrical lengths. By choosing a ratio close to the optimum, a low loss loaded transmission line with low bias voltage requirements may be obtained.

Figure 4:
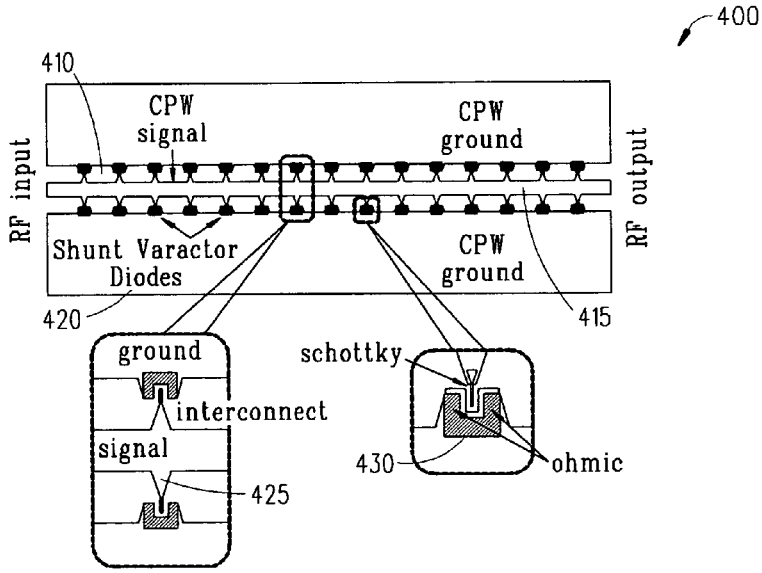
FIG. 4 is a fabrication layout of a CPW, using Schottky varactor diodes as a low impedance region in the distributed transmission line.

A topology illustrating the foregoing is illustrated in FIG. 4, generally at 400, which shows an arrangement with Schottky varactor diodes 430 (although this topology may also be used with ferro-electric varactors). However, the basic topology of FIG. 4 may not be optimized in terms of conductor losses, and in terms of total length (shorter lengths are more desirable). For instance, the narrow conductor, exemplified at 410 and in a larger view at 425, used to connect the CPW centre conductor 415 with the varactor 420 may cause unnecessary conductor losses.

The basic distributed or loaded line can be analyzed using a cascaded network formulation. In order to analyze parameter trade-offs, approximate equivalent macroscopic transmission line parameters may be derived for the loaded line, as shown generally as 500 in FIG. 5. Using these equivalent macroscopic transmission line parameters, 510, 520, 530 and 540, the loss trade-off can be calculated in terms of the alternating edge length ratio r, defined in FIG. 6 by assuming that the effective section lengths are roughly equal to the edge lengths. Thus, one pair of very short cascaded low and high impedance lines 505 may be equivalent to a short uniform impedance line 525.

Figure 7:
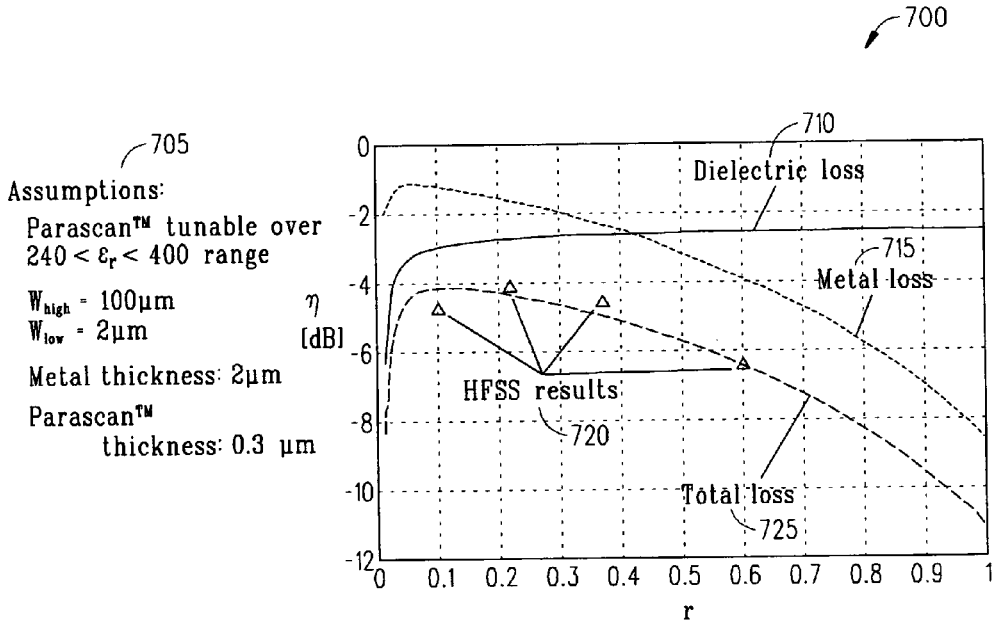
FIG. 7 is graph showing phase shifter efficiency η as a function of the alternating slot edge length ratio r.

The results are shown in FIG. 7 in the graph depicted generally as 700, for certain gap and material characteristics. Assumptions for the graph are set forth at 705 with total loss shown on the graph at 725, metal loss at 715, and dielectric loss at 710. From this we may infer that an edge ratio between r=0.1 and r=0.2 would be optimal for that particular case. The theoretical results have also been confirmed from finite element EM simulation using Ansoft's HFSS software, shown at 720. These simulations seem to favor a slightly higher edge ratio. The use of a small edge ratio, even though it may be near optimal, may result in an unpractical long phase shifter. For this reason it may be better to use a larger edge ratio which may be slightly above the optimal ratio.

Turning back to FIG. 6 at 600 is shown the topology of a loaded slotline geometry of one embodiment of the present invention. Although it is understood and will be discussed in greater detail below, there are a large number of topologies that may be used in the present invention. The wider conductors 630 used in FIG. 6 feeding the low impedance sections 625 (which may also be regarded as varactors, such as, but not limited to, Parascan® varactors) are better suited for producing a low loss phase shifter. The total length of a phase shifter based on this topology is still comparatively long (compared to a uniform slotline or CPW line). Metal is shown at 610 with narrow gap, high capacitance loads being illustrated at 605 followed by a uniform slotline 615. As previously mentioned, the edge ratio is shown at 620.

The following discussion will now focus on topologies that are more optimized in terms of losses in maximum length. However, it is understood that the topologies presented are for illustrative purposes only and it is understood that a large number of other topologies other than those presented may be utilized in the present invention.

Figure 8:
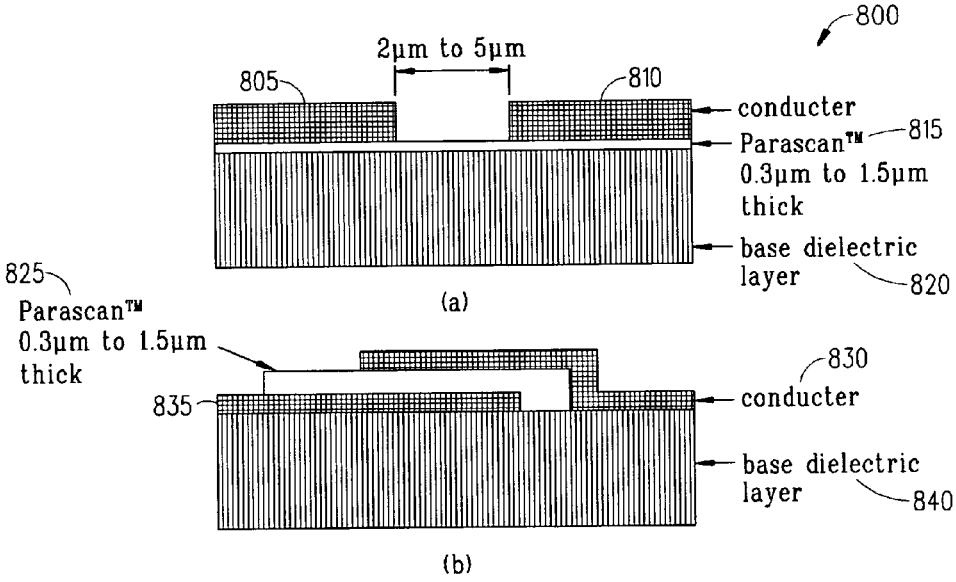
FIG. 8 illustrates two low impedance cross-section configurations: (a), which is simple narrow gap configuration and (b), which is an overlapped conductor configuration.

Turning now to FIG. 8, generally at 800, is an embodiment of the present invention that provides for a reduced loss, reduced length low bias voltage phase shifter including, but not limited to, two types of loaded slotline or CPW line cross-sectional topologies. In an embodiment, the topology may include, as cross-sectionally illustrated, two conductors 805 and 810 which may overlay a tunable dielectric layer (such as Parascan tunable dielectric) 815, forming a topology, such as a uniform or non-uniform gap therebetween. The tunable dielectric may further overlay a base dielectric layer 820. In one embodiment of the present invention, the gap between the two conductors may be between 2μ to 5 μm wide and the tunable dielectric layer may be 0.3 μm to 1.5 μm thick.

In another embodiment of the present invention one conductor 830 may partially overlay a second conductor 835 with a tunable dielectric material 825 separating the two conductors 835 and 830 (one example of a tunable dielectric that may be used is Parascan tunable dielectric). Further thickness of the tunable dielectric may be 0.3 μm to 1.5 μm thick and the conductors 835 830 with the tunable dielectric 825 therebetween may overlay a base dielectric layer and in an embodiment of the present invention, both conductors 830 and 835 and/or the tunable dielectric 825 may be in contact with the base dielectric layer 840. For example and not by way of limitation, as illustrated in FIG. 8, the entire conductor 835 may overlay and be in contact with base dielectric layer 840, with the tunable dielectric layer 825 partially overlaying conductor 835 and partially being in contact with base dielectric layer 840. Also, second conductor 830 may have a first portion partially overlaying the tunable dielectric 825 (which is partially overlaying conductor 835) and a second portion partially overlaying and in contact with base dielectric layer 840.

Figure 6:
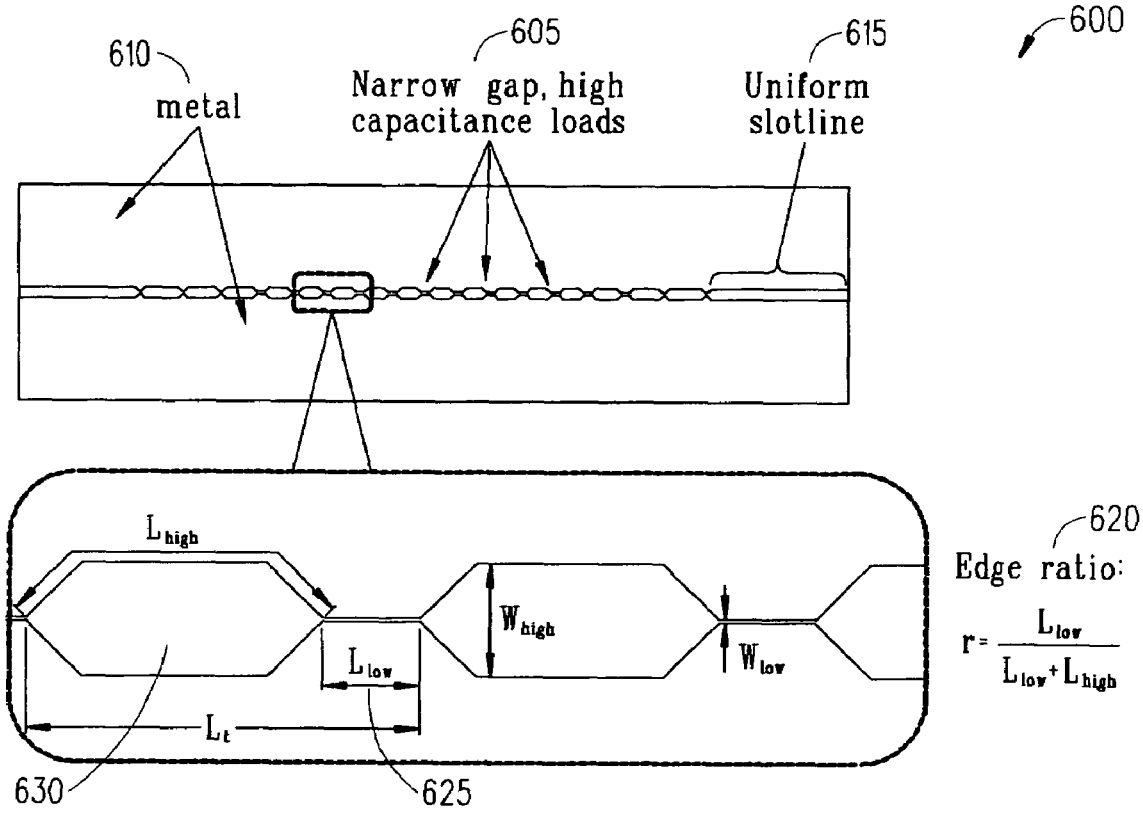
FIG. 6 shows a loaded slotline geometry of one embodiment of the present invention.

In an embodiment of the present invention, these may differ only in the cross-section topology used in the low impedance, tunable sections; although the present invention is not limited in this respect. Further, apart from the cross-section topologies shown in FIG. 8, there are also many possible geometric variations in the plane of the conductors, of which the particular one shown in FIG. 6 is but one possibility. Certain parameters for any given topology can be varied to determine the effect it will have on the total loss and the required length to achieve 360 degrees of phase shift within the material tuning range.

Figure 9:
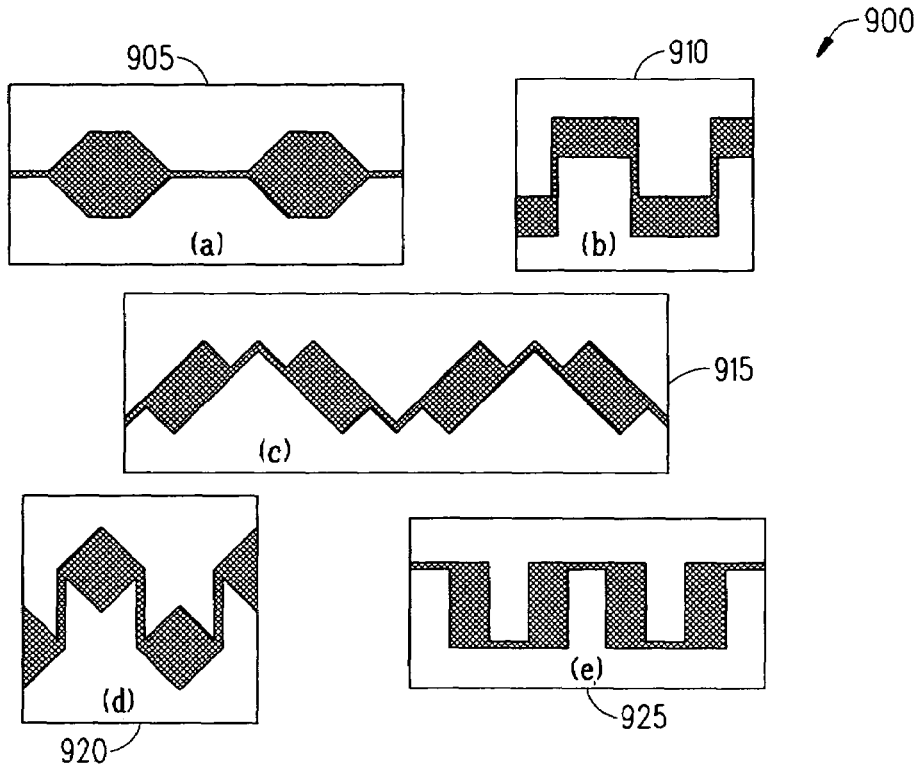
FIG. 9 depicts different loaded slotline geometries of several embodiment of the present invention.

Turning now to FIG. 9, shown generally at 900, are some carefully chosen conductor plane topologies that may be utilized in some embodiments of the present invention. Although not limited in this respect, the conductor plane topology may be as shown in 905, which includes at least one hexagonal shaped portion connected via a relatively narrower linear rectangular portion to a at least one additional hexagonal shaped portion and in a linear manner. Another topology, again of many potential topologies, illustrated at 910, may include at least one substantially rectangular portion connected via a relatively narrower segment to at least one additional substantially rectangular shaped portion and in an inverted manner. The embodiment at 915 may include at least one substantially rectangular portion connected via a relatively narrower segment to at least one additional substantially rectangular shaped portion and in an orthogonal manner.

The embodiment at 925 may include at least one substantially rectangular portion connected via a relatively narrower segment to at least one additional substantially rectangular shaped portion and in a vertical and symmetrical manner. Yet another embodiment, as shown at 920, may include at least one substantially square portion with a substantially vertically facing corner connected by a horizontally facing corner via a relatively narrower segment to a horizontally facing corner of at least one additional substantially square shaped portion with a vertically facing corner and in a non-linear manner.

General performance characteristics of the aforementioned topologies include that geometries (a) 905, (c) 915 and (d) 920 in general have the lower loss characteristics, with (a) 905 having the lowest loss and (b) 910 the highest loss. On the other hand, geometries (b) 910, (d) 920, and (e) 925 would yield shorter phase shifter lengths, with (a) 905 yielding the longest length and (e) 925, (b) 910 the shortest lengths.

Figure 5:
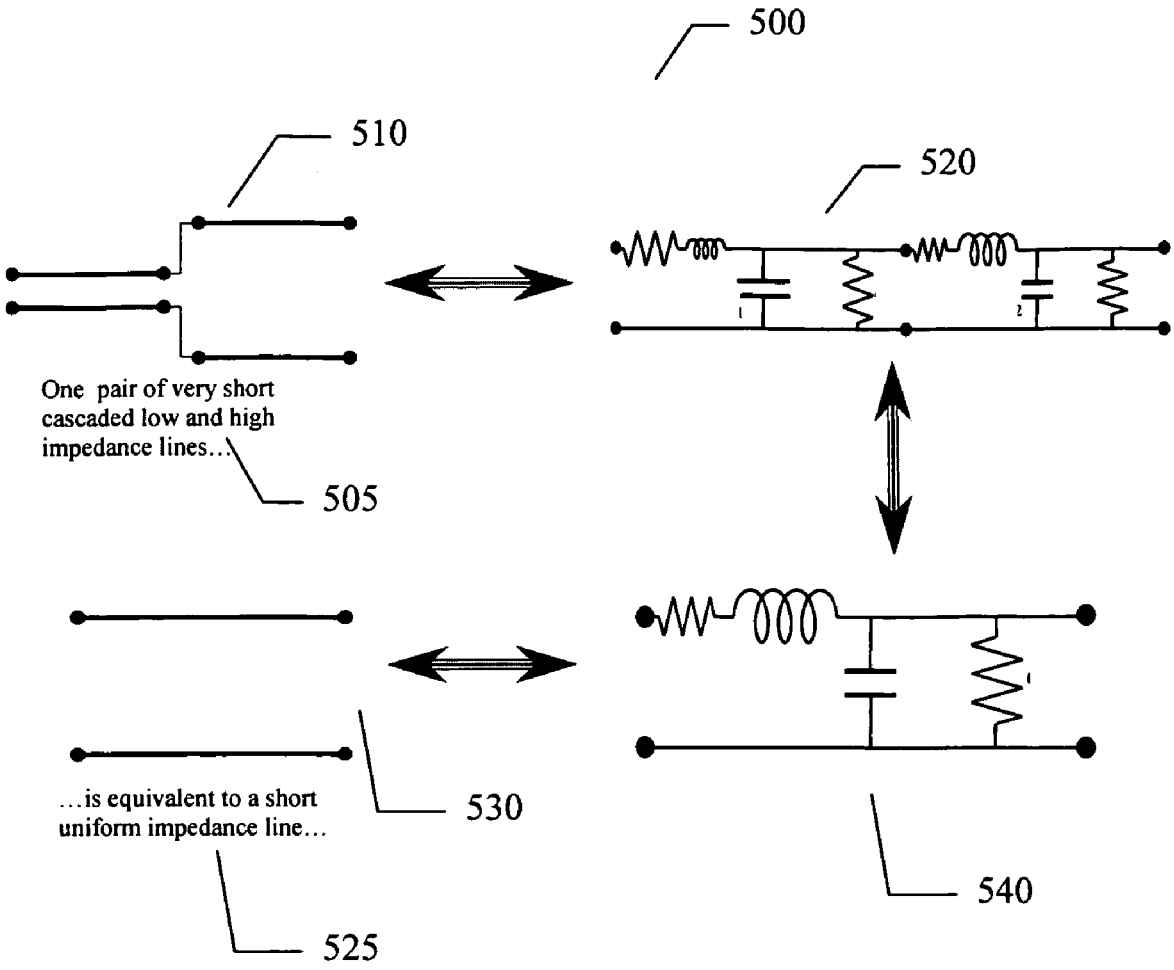
FIG. 5 shows a derivation of the equivalent macroscopic uniform transmission line parameters of a loaded transmission line which depicts other excitation techniques for feeding the lower patch of one embodiment of the present invention.

The geometry with the best combination of loss and total phase shifter length properties may be (d) 920. A shorter length may usually be achieved simply by increasing the edge ratio r, but that would also increase the total loss as seen in FIG. 5. For this reason, the conductor plane geometry may be very important in reducing the total length while preserving low loss properties.

Figure 10:
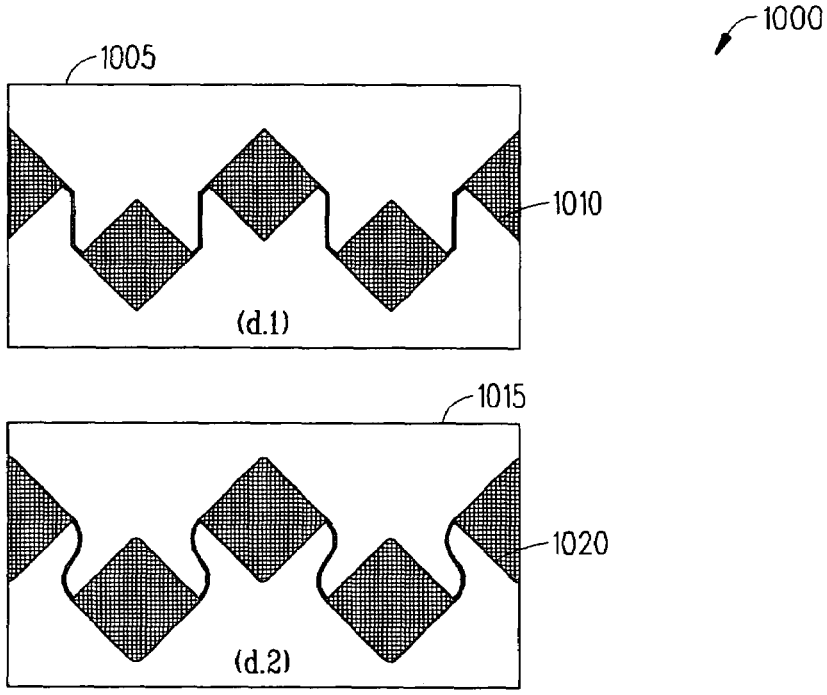
FIG. 10 shows variations on loaded slotline geometry (d) in FIG. 9.

Some slight variations on geometry (d) 920 are shown in FIG. 10, generally illustrated as 1000. In both cases 1005 and 1015, blunter corner edges 1010 or more rounded conductor edges 1020 are used respectively to reduce conductor current losses. A loaded CPW slotline can be obtained by just running two copies of any of the loaded slot geometries in parallel.

While the present invention has been described in terms of what are at present believed to be its preferred embodiments, those skilled in the art will recognize that various modifications to the disclose embodiments can be made without departing from the scope of the invention as defined by the following claims. Further, although a specific scanning antenna utilizing dielectric material is being described in the preferred embodiment, it is understood that any scanning antenna can be used with any type of reader any type of tag and not fall outside of the scope of the present invention.

What is claimed is:

1. A phase shifter, comprising:

a base dielectric layer;

a tunable dielectric layer overlaying at least a portion of said base dielectric layer; and at least two conductors, with one conductor having higher relative impedance than another conductor having lower impedance, overlaying at least a portion of said tunable dielectric layer, said at least two conductors positioned so as to define a slot-line topology, wherein said slot-line topology has an edge ratio defined by $r=L_{low}/(L_{low}+L_{high})$, with $L_{high}$ being the impedance of the conductor with higher relative impedance and $L_{low}$ being the impedance of the conductor with lower impedance.

2. The phase shifter of claim 1, wherein said slot-line topology is between 2 μm and 5 μm wide.

3. The phase shifter of claim 1, wherein said tunable dielectric layer is between 0.3 μm to 1.5 μm thick.

4. The phase shifter of claim 1, wherein said slot-line topology includes at least one substantially square portion with a substantially vertically facing corner connected by a horizontally facing corner via a relatively narrower segment to a horizontally facing corner of at least one additional substantially square shaped portion with a vertically facing corner and in a non-linear manner.

5. The phase shifter of claim 1, wherein said slot-line topology includes at least one substantially rectangular portion connected via a relatively narrower segment to at least one additional substantially rectangular shaped portion and in a vertical and symmetrical manner.

6. The phase shifter of claim 1, wherein said edge ratio is optimized for minimizing metal loss of both said at least two conductors and minimizing dielectric loss of said tunable dielectric layer for a given phase shifter length.

7. The phase shifter of claim 1, wherein r is between 0.1 and 0.2.

8. The phase shifter of claim 1, wherein said slot-line topology is one which includes at least one hexagonal shaped portion connected via a relatively narrower rectangular linear portion to a at least one additional hexagonal shaped portion and in a linear manner.

9. The phase shifter of claim 1, wherein said slot-line topology includes at least one substantially rectangular portion connected via a relatively narrower segment to at least one additional substantially rectangular shaped portion and in an orthogonal manner.

10. A phase shifter, comprising:

a base dielectric layer;

a first conductor overlaying at least a portion of said base dielectric layer;

a tunable dielectric layer overlaying at least a portion of said base dielectric layer and a portion of said first conductor; and a second conductor, with higher relative impedance to said first conductor, overlaying at least a portion of said tunable dielectric layer and a portion of said base dielectric layer, wherein said second conductor overlaying at least a portion of said tunable dielectric layer and a portion of said base dielectric layer defines a slot-line topology and wherein said slot-line topology has an edge ratio defined by $r=L_{low}/(L_{low}+L_{high})$, with $L_{high}$ being the impedance of said second conductor with the higher relative impedance and $L_{low}$ being the impedance of said first conductor with lower impedance.

11. The phase shifter of claim 10, wherein r is between 0.1 and 0.2.

12. The phase shifter of claim 10, wherein said slot-line topology is one which includes at least one hexagonal shaped portion connected via a relatively narrower linear portion to a at least one additional hexagonal shaped portion and in a linear manner.

13. The phase shifter of claim 10, wherein said edge ratio is optimized for minimizing metal loss of both said first and second conductors and minimizing dielectric loss of said tunable dielectric layer for a given phase shifter length.

14. The phase shifter of claim 10, wherein said slot-line topology includes at least one substantially rectangular portion connected via a relatively narrower segment to at least one additional substantially rectangular shaped portion and in an orthogonal manner.

15. The phase shifter of claim 10, wherein a portion of said tunable dielectric layer that said second conductor overlays, is a portion that includes the portion wherein said tunable dielectric layer overlays said first conductor.

16. The phase shifter of claim 10, wherein said slot-line is between 2 μm and 5 μm wide.

17. The phase shifter of claim 10, wherein said tunable dielectric layer is between 0.3 μm to 1.5 μm thick.

18. The phase shifter of claim 10, wherein said slot-line topology includes at least one substantially rectangular portion connected via a relatively narrower segment to at least one additional substantially rectangular shaped portion and in a vertical and symmetrical manner.

19. The phase shifter of claim 10, wherein said slot-line topology includes at least one substantially square portion with a substantially vertically facing corner connected by a horizontally facing corner via a relatively narrower segment to a horizontally facing corner of at least one additional substantially square shaped portion with a vertically facing corner and in a non-linear manner.

20. A phase shifter, comprising:

a base dielectric layer;

a tunable dielectric layer overlaying at least a portion of said base dielectric layer; and at least two conductors overlaying at least a portion of said tunable dielectric layer, said at least two conductors positioned so as to define a slot-line topology; and wherein said slot-line topology includes at least one substantially rectangular portion connected via a relatively narrower segment to at least one additional substantially rectangular shaped portion and in an orthogonal manner.

21. A phase shifter, comprising:

a base dielectric layer;

a tunable dielectric layer overlaying at least a portion of said base dielectric layer; and at least two conductors overlaying at least a portion of said tunable dielectric layer, said at least two conductors positioned so as to define a slot-line topology; and wherein said slot-line topology includes at least one substantially rectangular portion connected via a relatively narrower segment to at least one additional substantially rectangular shaped portion and in a vertical and symmetrical manner.

22. A phase shifter, comprising:

a base dielectric layer;

a tunable dielectric layer overlaying at least a portion of said base dielectric layer; and at least two conductors overlaying at least a portion of said tunable dielectric layer, said at least two conductors positioned so as to define a slot-line topology; and wherein said slot-line topology includes at least one substantially square portion with a substantially vertically facing corner connected by a horizontally facing corner via a relatively narrower segment to a horizontally facing corner of at least one additional substantially square shaped portion with a vertically facing corner and in a non-linear manner.

23. A method of tuning a phase shifter, comprising:

applying a voltage across a slot-line topology, said slot-line topology formed from:

a base dielectric layer;

a tunable dielectric layer overlaying at least a portion of said base dielectric layer;

at least two conductors, with one conductor having higher relative impedance than another conductor having lower impedance, overlaying at least a portion of said tunable dielectric layer, said at least two conductors positioned so as to define said slot-line topology and wherein said slot-line topology has an edge ratio defined by $r=L_{low}/(L_{low}+L_{high})$, with $L_{high}$ being the impedance of the conductor with the higher relative impedance and $L_{low}$ being the impedance of the conductor with the lower impedance.

24. A method of tuning a phase shifter, comprising:

applying a voltage across a slot-line topology, said slot-line topology formed from:

a base dielectric layer;

a first conductor overlaying at least a portion of said base dielectric layer;

a tunable dielectric layer overlaying at least a portion of said base dielectric layer and a portion of said first conductor;

a second conductor, with higher relative impedance to said first conductor, overlaying at least a portion of said tunable dielectric layer and a portion of said base dielectric layer, wherein said second conductor overlaying at least a portion of said tunable dielectric layer and a portion of said base dielectric layer defines a slot-line topology and wherein said slot-line topology has an edge ratio defined by $r=L_{low}/(L_{low}+L_{high})$, with $L_{high}$ being the impedance of said second conductor with the higher relative impedance and $L_{low}$ being the impedance of said conductor with lower impedance.

25. A phase shifter, comprising:

a base dielectric layer;

a tunable dielectric layer overlaying at least a portion of said base dielectric layer; and at least two conductors overlaying at least a portion of said tunable dielectric layer, said at least two conductors positioned so as to define a slot-line topology; and wherein said slot-line topology is one which includes at least one hexagonal shaped portion connected via a relatively narrower rectangular linear portion to at least one additional hexagonal shaped portion and in a linear manner.

* * * * *